United States Patent [19]

Ebert

[11] 4,274,311

[45] Jun. 23, 1981

[54] RATCHET WRENCH HANDLE

[76] Inventor: Emil Ebert, 2900 S. 9th Ave., Broadview, Ill. 60153

[21] Appl. No.: 59,588

[22] Filed: Jul. 23, 1979

[51] Int. Cl.[3] ..... B25B 13/46

[52] U.S. Cl. ..... 81/63; 192/43.1

[58] Field of Search ..... 81/63, 63.1, 63.2; 192/43.1; 74/99 A, 100 R, 100 P

[56] References Cited

U.S. PATENT DOCUMENTS

| | | | |
|---|---|---|---|
| 1,854,513 | 4/1932 | Heimmel | 81/63 |
| 1,868,839 | 7/1932 | McNaught et al. | 81/63 |
| 2,542,241 | 2/1951 | Fors | 81/63 |
| 3,145,594 | 8/1964 | Peters | 81/63 |
| 3,608,402 | 9/1971 | Rainey | 81/63.1 |
| 3,659,484 | 5/1972 | Codeller | 81/63 |
| 3,724,298 | 4/1973 | Howard | 81/63 |

*Primary Examiner*—James L. Jones, Jr.
*Attorney, Agent, or Firm*—Balogh, Osann, Kramer, Dvorak, Genova & Traub

[57] ABSTRACT

A reversible ratchet handle having a head portion and lever arm portion integrally formed. The head portion receives a rotatable tool driven in its upper section, the tool driven having a ratchet wheel with a toothed edge, and a pivotable circular switching member in its lower section. The switching member is provided with a pair of oppositely disposed toothed portions for selectively engaging the toothed edge of the ratchet wheel. In addition, the switching member is provided with a slot at its lower section, which slot defines a cam surface at the mid section of the switching member.

The lever arm portion consists of an elongated tube and a rod telescopically and longitudinally disposed in the tube. The inner end of the rod extends into the slot of the switching member and is adapted to engage the cam surface thereof. A plunger-type push button is disposed at the outer end of the tube and is connected to the outer end of the rod. Upon actuation of the push-button the rod engages the cam surface which in turn causes the switching member to pivotally rotate and selectively engage the tool driven so as to change the direction of its rotation to an opposite direction.

7 Claims, 6 Drawing Figures

DETAIL OF ITEM #5

SECTION A-A

SECTION B-B

RATCHET WRENCH HANDLE

BACKGROUND OF THE INVENTION

The invention relates to a ratchet handle and in particular to a reversible ratchet handle for socket wrenches and the like.

Socket wrenches are known as one of the most versatile and widely used wrenches in the mechanical arts. They consist basically of a detachable handle and a socket type wrench which can be affixed to the handle. The handle is adapted to fit sockets of various sizes and shapes. Various types of handles are known to be used with a socket type wrench, each type having its special advantages and disadvantages.

It is known that a ratchet handle is most advantageous for use with a socket type wrench, especially in location where conventional handle travel is limited. For example, when a nut or bolt are located in a corner where there is no space, a ratchet handle attached to the socket wrench is preferable.

A conventional ratchet handle has a reversing lever which operates a pawl inside the head of the handle. Pulling the handle in one direction causes the pawl to engage in the ratchet teeth and turn the socket. Moving the handle in the opposite direction causes the pawl to slide over the teeth, permitting the handle to back up without moving the socket with the reversing lever in one position the handle can be used for tightening, and when in the other position the handle can be used for loosening. However problems have been developed, which interfere in the efficient and economic use the conventional ratchet handle. The problems involve difficulties in shifting of the reversing lever or reversing the direction of rotation of the tool driver in certain mechanical operations and in particular work places. For example when a socket wrench is used to tighten or loosen a bolt or nut located in a machine corner, and the conventional ratchet handle, having the reversing lever in the head of the tool is inserted into the corner, the reversing lever could not be reached in order to reverse the direction of rotation of the wrench. The working operation has to be stopped and the tool disengaged in order to adjust the reversing lever.

In the same manner in other working operations these difficulties resulted in increased production labor and operating costs as well as decreasing the level of productivity and efficiency.

The present invention substantially eliminates the aforementioned difficulties encountered in the use of conventional ratchet handles. It provides for a reversible ratchet handle that allows for instantaneous shifting or reversal of the direction of rotation of the tool driver or socket wrench when used in any mechanical operation and in diverse work places.

The present invention provides for an improved ratchet handle that allows a most efficient and economic use of socket type wrenches.

SUMMARY OF THE INVENTION

In accordance with the invention the reversible ratchet handle is equipped with a pivotably mounted and particularly shaped switching member (for engaging the tool driver) which is coupled to a plunger-type push button mechanism. When the push button mechanism is actuated, it engages the switching member, causing it to pivotally rotate and selectively engage the tool driver and change the rotation thereof from one direction to an opposite direction.

In particular, the invention contemplates the following ratchet handle structure. The handle tool has a head portion and a lever arm portion extending in the opposite direction of the head portion. Both portions may be integrally formed or attached as separate elements. The head portion is provided with a pair of adjacent recessed circular sections which are disposed one on top of the other and intersect one another. A tool driver is rotatably mounted in the upper section adjacent to the top or upper end of the head portion.

The tool driver consists of a ratchet wheel having a toothed peripheral edge and an outwardly extending portion that may be square rectangular or any other shape that could fit into a socket type wrench. A circular shaped switching member is pivotally mounted in the lower section of the head portion immediately adjacent to the tool driver. The upper end of the switching member (facing the tool driver) is flat and provided with toothed portions at its opposite edges. One of the toothed portions is adapted to engage the toothed edge of the ratchet wheel (of the tool driver), while the other toothed portion is in a non-engaging position.

The switching member is also provided with a central slot at the mid section of its lower end. This slot defines a pointer-shaped cam surface located above it, at the central section of the switching member.

The lever arm portion of the handle consists of an elongated tube, and a spring rod telescopically and longitudinally mounted in the tube. The inner end of the rod extends into the head portion and into the central slot of the switching member, for engaging the same.

A push button is mounted at the outer end of the tube, the button being attached or connected to the rod. When the push button is actuated the rod is engaged to push forward or engage otherwise the pointer-shaped cam surface which in turn causes the switching member to pivotally rotate and disengage one of its toothed portions from the toothed edge of the ratchet wheel, while bringing the other toothed portion (which was in a non-engaging position) into engagement with the toothed edge of the ratchet wheel. In this manner by selectively engaging the tool driver the switching member in effect changes the direction of rotation of the tool driver from one direction to an opposite direction. Once the switching member is actuated to reverse the direction of rotation of the tool driver, the former is locked or firmly held in one position by means of a compression spring disposed between the lower end of the switching member and lower end of the lower section of the head portion.

In the same manner a compression spring attached to the outer end of the rod and supported by the inner end of the push button, serves to urge the rod into disengagement from the cam surface and return to its non-operating position.

Various other details objects and advantages will appear from the following description of the preferred embodiment of this invention as shown in the accompanying drawings.

DETAILED DESCRIPTION OF THE INVENTION

Figure 1:
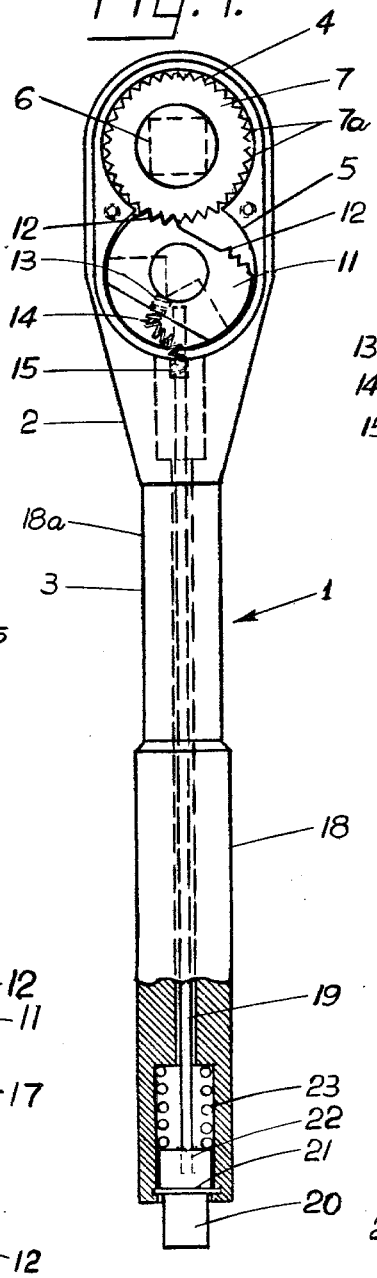
FIG. 1 is an elevational front view of the ratchet handle according to the invention with a portion of the handle shown in section, and with the cover plate removed.
Figure 2:
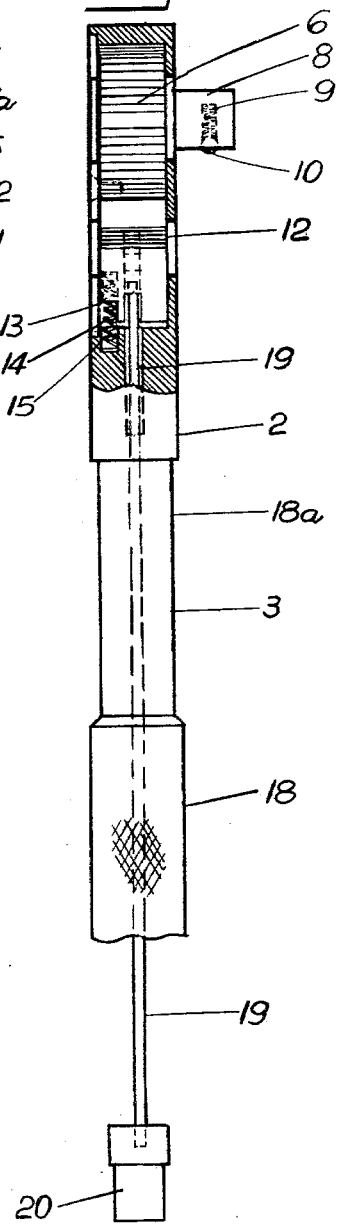
FIG. 2 is an elevational side view partly in section of the embodiment of FIG. 1, with a portion of the handle broken out.

The essential form of the invention or the preferred embodiment is illustrated in FIGS. 1–2 and defines the ratchet handle structure as follows:

A ratchet handle 1 includes a head portion 2 and an elongated lever arm portion 3, which may be attached together as two separate elements or preferably formed as a single integral unit. The head portion 2 includes a pair of adjacent recessed circular sections 4, 5 which intersect one another. Section 4 is located at the top of the head portion 2 (above section 5). Sections 4 and 5 are each provided with a central transversing bore, the bore of section 4 being larger in diameter than that of section 5.

A tool driver 6 is rotatably mounted in section 4 of head portion 2, via the central bore therein. Tool driver 6 consists of a ratchet wheel 7 having a toothed peripheral edge 7*a* and an outwardly extending portion 8 attached to ratchet wheel 7 for engaging a suitable socket wrench. Portion 8 is provided with a recess 9 for receiving a spring loaded compression ball 10 which is necessary for holding the tool driver in the socket. Portion 8 may have a square shape or any other rectangular or cylindrical shape which fits particular sockets. Spring loaded ball 10 is adapted to fit into a recess in the socket receptacle of a suitable socket-wrench. During normal usage, when tool driver 6 engages a socket wrench, this mated ball-recess feature keeps the socket engaged with portion 8 of the tool driver.

Figure 6:
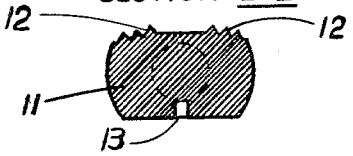
FIG. 6 is a sectional view of the switching member as shown in FIG. 4, taken along the section line B—B.

A switching member 11 is pivotably mounted in section 5 of head portion 2, via the central bore therein. Switching member 11 is circular in shape and having a flat upper end which is provided with a pair of equal toothed portions 12 disposed at opposite edges thereof. Each of the toothed portions 12 is adapted to engaged or mesh with the toothed edge 7*a* of ratchet wheel 7. As illustrated in FIG. 6 the lower edge of the front face of switching member 11 is recessed, the lower end of the front face being provided with a recess 13 for receiving a compression spring 14. The lower end of compression spring 14 is disposed in a recess 15 located at the lower end of section 5. Spring 14 is disposed in an arced compression position between the switching member 11 and the lower end of section 5 in order to hold the switching member in a locked position once it has selectively engaged ratchet wheel 7, so it continuously engages the tool driver 6 in rotation in a particular or predetermined direction.

Figure 4:
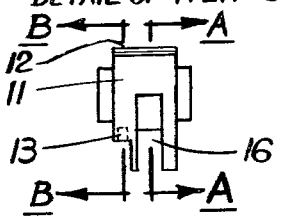
FIG. 4 is an elevational side view of the switching member of the invention.
Figure 5:
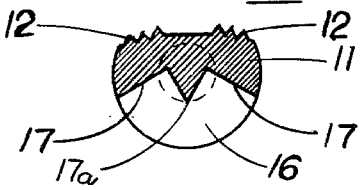
FIG. 5 is a sectional view of the switching member as shown in FIG. 4, taken along the section line A—A.

As shown in FIGS. 4–6, switching member 11 is also provided with a central slot 16 located in the mid or central section of its lower end, and transversing or extending throughout the longitudinal cross section of the lower end of the switching member. The central slot 16 defines a pointer-shaped cam surface 17, having an edge-point 17*a* and disposed above the slot 16 and at the central or mid cross section of switching member 11.

As shown in FIGS. 1–2, the lever arm portion 3 includes an elongated tube 18 which is preferably integrally formed with head portion 2 (it may, though be a separate element attached to head 2). Tube 18 has a neck portion 18*a* adjacent to head portion 2 which is of a smaller diameter than the rest of tube 18.

The outside surface of tube 18, to the exclusion of neck portion 18*a* is preferably knurled. An elongated spring rod 19 is telescopically and longitudinally disposed in tube 18. The inner end of rod 19 extends into head portion 2 and is disposed in slot 16 of switching member 11. Rod 19, at its inner end is adapted to engage or selectively push the pointer shaped cam surface 17, so as to cause the switching member 11 to pivotally rotate and selectively disengage one of tooth portions 12 from engagement with the toothed edge 7*a* of ratchet wheel 7, while at the same time moving another toothed portion 12 into engagement with toothed edge 7*a* and thereby cause the direction of rotation of tool driver 6 to change to an opposite direction.

A plunger-type push-button 20 is mounted or disposed inside the outer end of tube 18. A portion of push-button 20 extends outside the tube 18 or lever arm portion 2. However, another portion of push-button 20 is inserted inside the tube 18 and is firmly held there by means of a spirolock ring or snap ring 21, which serves as a stop for push-button 20. The portion of push-button 20 held inside tube 18 has a slot 22 at the middle section of its upper end, for receiving the outer or lower end of rod 19.

A portion of the lower end of rod 19, adjacent to push-button 20 is embraced or surrounded by a compression spring 23. The spring 23 is supported by the inner portion of push-button 20, and constitutes the means for holding push-button 20 and spring rod 19 in a non-operating position.

After switching member 11 selectively engages ratchet wheel 7 and changes the direction of its rotation, switching member 11 is locked into position by spring 14 while compression spring 23 urges the rod 19 out of engagement with pointer-shaped cam surface 17 and rod 19 as well as push-button 20 return to their non-operating position.

Figure 3:
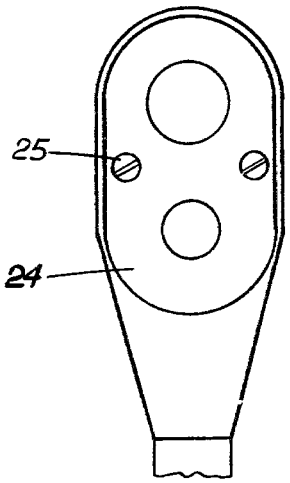
FIG. 3 is a fragmentary front view of the ratchet handle according to the invention, illustrating the head portion with the cover plate added.

In accordance with FIG. 3 head portion 2 is provided with a cover plate 24 for its front face. The cover plate 24 is provided with slots corresponding to the respective central bores of sections 4 and 5 of head portion 2. Cover plate 24 is secured to head portion 2 by means of screws 25.

FIGS. 4–6 illustrate switching member 11 in detail and in two different cross sections. It should be noted that pointer-shaped cam surface 17 is disposed in a particular angular position when the left end toothed portion 12 engages toothed edge 7*a* of ratchet wheel 7 (see hidden lines in switching member 11 as shown in FIG. 1). When the pointer-shaped cam surface 17 is in that angular position rod 19 when actuated will engage or push cam surface 17 at the right side of edge-point 17*a*. As a result the switching member will pivotally rotate to bring the right end toothed portion 12 into engagement with toothed edge 7*a* of ratchet wheel 7.

When the latter teeth engagement takes place, the pointer-shaped cam surface will be in an opposite angular position. In this case when rod 19 is actuated it will engage or push cam surface 17 from the left end of edge-point 17*a*. As a result the switching member will pivotally rotate to bring the left-end toothed portion 12 into engagement with toothed edge *7a* of ratchet wheel 7.

In summary, each actuation of the switching member by the rod causes pivotal rotation of the switching member, which determines which direction the wrench will be engaging and which direction will be non-engaging or ratcheting.

It is to be understood that it is contemplated that the subject of this invention will be made of hardened steel or any other suitable material that will fit the purpose.

Although but one specific embodiment of the invention has been herein shown and described, it will be understood that numerous details of the construction shown may be altered or omitted without departing from the spirit of the invention, as defined by the following claims.

What is claimed is:

1. A reversible ratchet handle for a socket wrench comprising a head portion and an elongated lever arm portion attached to the head portion and extending in the opposite direction therefrom, said head portion comprising first and second sections adjacent to each other and formed in said head portion in the shape of circular recessed areas intersecting one another, a tool driver being rotatably mounted in said recessed area of said first section for engaging a socket wrench, a switching member pivotably mounted in said recessed area of said second section, for selectively engaging said tool driver and changing the rotation thereof from one direction to an opposite direction, means for actuating said switching member so that it selectively engages and changes direction of rotation of said tool driver, and means for locking said switching member in position so that it continuously engages said tool driver in rotation in a predetermined direction, said lever arm portion including an elongated tube integrally formed with said head portion, and said actuating means including a rod telescopically and longitudinally disposed in said tube, the inner end thereof engaging said switching member, and a plunger-type push-button mounted at the outer end of said tube, said push-button being attached to the outer end of said rod and engaging the same such that each time said push-button is actuated, said rod engages said switching member to pivotally rotate and disengage one of its toothed portions from engagement with said toothed edge of said ratchet wheel, while at the same time moving another of its toothed portions into engagement with said toothed edge of said ratchet wheel, so as to effect a change in rotation of said ratchet wheel from one direction to the opposite direction thereof.

2. A reversible ratchet handle according to claim 1, in which said tool driver comprises a ratchet wheel having a toothed peripheral edge and an outwardly extending member integrally formed with said wheel for engaging a socket wrench, and in which said switching member comprises a pair of oppositely disposed toothed portions located at the end thereof facing said tool driver, so that when one toothed portion engages the toothed edge of said ratchet wheel, the other toothed portion is in a non-engaging position.

3. A reversible ratchet handle according to claim 2, in which said switching member is circular in shape, the upper end thereof that faces said driver tool, being flat, and said toothed portions being disposed on opposite edges of said flat end, so that when one toothed portion engages the toothed edge of said ratchet wheel the other toothed portion is in a non-engaging position.

4. A reversible ratchet handle according to claim 1, in which said switching member further comprises a central slot located in the midsection of its lower end and extending throughout the longitudinal cross section of said lower end, said central slot defining a pointer-shaped cam surface disposed at the central cross section of said switching member, and in which the inner end of said rod is disposed in said central slot and engages said cam surface to pivotally rotate said switching member so that one of its toothed portions engages the toothed edge of said ratchet wheel, and changes the rotation thereof from one direction to the opposite direction thereof.

5. A reversible ratchet handle according to claim 2, in which said locking means comprises a compression spring holding said switching member in a locked position for continuously engaging said ratchet wheel in rotation in a predetermined direction.

6. A reversible ratchet handle according to claim 3, in which said locking means comprise a spring disposed in an arced compression position between said switching member and the lower end of said recessed area of said second section, so as to hold said switching member in a locked position for continuously engaging said ratchet wheel in rotation in a predetermined direction.

7. A reversible ratchet handle according to claim 4, further comprising spring means for urging said rod out of engagement with said cam surface and into a non-engaging position.

* * * * *